US012146488B2

(12) United States Patent
Spybey et al.

(10) Patent No.: US 12,146,488 B2
(45) Date of Patent: Nov. 19, 2024

(54) MANUALLY OPERATED PUMP ASSEMBLY

(71) Applicant: Kickstart International, Inc., San Francisco, CA (US)

(72) Inventors: Alan Charles Spybey, Nairobi (KE); Martin John Fisher, San Francisco, CA (US); Albert Lukhale, Nairobi (KE); Fredrick Omondi Obudho, Nairobi (KE); Simon Maina Mugo, Nairobi (KE)

(73) Assignee: Kickstart International, Inc., San Francisco, CA (US)

( * ) Notice: Subject to any disclaimer, the term of this patent is extended or adjusted under 35 U.S.C. 154(b) by 0 days.

(21) Appl. No.: 17/570,219

(22) Filed: Jan. 6, 2022

(65) Prior Publication Data

US 2022/0381233 A1 Dec. 1, 2022

Related U.S. Application Data

(63) Continuation of application No. 16/382,748, filed on Apr. 12, 2019, now abandoned, which is a (Continued)

(51) Int. Cl.
*F04B 9/14* (2006.01)
*F04B 39/10* (2006.01)
(Continued)

(52) U.S. Cl.
CPC ..... *F04B 9/14* (2013.01); *F04B 39/1073* (2013.01); *F04B 53/1047* (2013.01);
(Continued)

(58) Field of Classification Search
CPC ..... F04B 9/14; F04B 53/1047; F04B 53/109; F04B 39/1073; F04B 53/143; F04B 53/166
See application file for complete search history.

(56) References Cited

U.S. PATENT DOCUMENTS 2,616,583 A * 11/1952 Rausenberger ..... B64D 37/005 220/249
2,859,912 A * 11/1958 Swart ..... F04B 39/1073 137/527
(Continued)

FOREIGN PATENT DOCUMENTS

CN 101076379 A 11/2007
CN 106536064 A 3/2017
(Continued)

OTHER PUBLICATIONS

First Office Action issued by the China National Intellectual Property issued on Sep. 21, 2020, for CN Application No. 201780078188.3 (10 pages).

*Primary Examiner* — Charles G Freay
*Assistant Examiner* — Lilya Pekarskaya
(74) *Attorney, Agent, or Firm* — Goodwin Procter LLP

(57) ABSTRACT

A manually operated pump exhibiting numerous improvement over existing such pumps is described. The pump can include a cylinder that is removeably mounted to a molded valve box of unitary construction. The valve box can feature a valve plate covering a valve chamber and housing an inlet valve and an outlet valve. In some instances, the pump includes a molded piston of unitary construction to which a pair of opposing piston cups is mounted. In some cases, the pump includes a filler cap forming an inlet adapted to deliver a priming fluid into the cylinder. In some cases, the pump includes a stopper cap adapted to prevent a pump shaft from being fully pulled out of the cylinder.

18 Claims, 11 Drawing Sheets

Related U.S. Application Data continuation of application No. PCT/US2017/061547, filed on Nov. 14, 2017.

(60) Provisional application No. 62/421,662, filed on Nov. 14, 2016.

(51) Int. Cl.
*F04B 53/10* (2006.01)
*F04B 53/14* (2006.01)
*F04B 53/16* (2006.01)

(52) U.S. Cl.
CPC ..... *F04B 53/109* (2013.01); *F04B 53/143* (2013.01); *F04B 53/166* (2013.01)

(56) References Cited

U.S. PATENT DOCUMENTS

| | | | | |
|---|---|---|---|---|
| 2,868,135 | A | 1/1959 | Reinertson | |
| 5,494,411 | A * | 2/1996 | Chuang | F04B 33/00 92/58.1 |
| 7,396,218 | B2 * | 7/2008 | Hyde | F04B 9/14 417/903 |
| 7,517,306 | B2 * | 4/2009 | Fisher | F04B 53/105 482/92 |
| 8,770,954 | B2 * | 7/2014 | Spybey | F03G 5/08 417/523 |
| 2003/0228228 | A1 * | 12/2003 | Whisenant | F04B 7/04 417/490 |
| 2008/0039300 | A1 | 2/2008 | Fisher et al. | |
| 2017/0197776 | A1 * | 7/2017 | Nasr | B05B 7/0483 |

FOREIGN PATENT DOCUMENTS

| | | | |
|---|---|---|---|
| EP | 0582159 | A1 | 2/1994 |
| FR | 1346176 | A | 12/1963 |
| WO | WO-2013190287 | A1 | 12/2013 |

* cited by examiner

MANUALLY OPERATED PUMP ASSEMBLY

CROSS-REFERENCE TO RELATED APPLICATIONS

This application is a continuation of U.S. patent application Ser. No. 16/382,748, filed Apr. 12, 2019, and entitled "Manually Operated Pump Assembly," which is a continuation of International Application Serial No. PCT/US2017/061547, filed Nov. 14, 2017, and entitled "Manually Operated Pump Assembly," which claims priority to and the benefit of U.S. Provisional Patent Application No. 62/421,662, filed on Nov. 14, 2016, and entitled "Manually Operated Pump Assembly," the disclosures of both of which are incorporated by reference herein in their entireties.

TECHNICAL FIELD OF THE INVENTION

The invention relates generally to a manually operated pump and, more particularly, to a manually operated pump that is pivotally mounted to a base and features various improvements over prior manual pumps.

BACKGROUND

Pumps for transporting fluid from one location to another are a key technology for many commercial industries. For example, the farming industry uses pumps to transport water to irrigate crops. In modern times, in many industrialized countries, pumps now feature automated devices operated by electric motors, robots, computers, etc. However, in certain less developed regions of the world (e.g., certain regions of Africa), such modern technologies are not economically feasible. In such regions, there is still a need for cheaper and more accessible manually operated pumps. In fact, it has been shown that the use of such pumps to irrigate crops with underground water can dramatically improve agricultural production. The ability to irrigate crops during the dry season, when natural rain water is scarce, has been proven to perpetuate a reoccurring cycle of success for farmers using these pumps. More information can be found at: http://kickstart.org/

U.S. Pat. No. 7,517,306 describes a manually operated pump that includes a piston and cylinder pumping mechanism pivotally connected to a base. This arrangement enables an operator to drive the piston in and out of the cylinder, causing fluid to be pulled from a remote source and then pushed to a delivery location. The pivot connection enables improved and more energy-efficient performance of the piston driving action. For example, users can rock their hips back and forth while moving their arms in a rowing motion (as such, the pump described in U.S. Pat. No. 7,517,306 will sometimes be referred to herein as the "hip pump"). Users can also use their back and leg muscles, as opposed to just their arm muscles, as is the case in many conventional manual pumps.

U.S. Pat. No. 8,770,954 describes another manually operated pump that includes a pair of treadles attached to a rocker pivot mounted on a frame. A user stepping on the treadles causes alternate driving of a piston in and out of each of two cylinders, causing fluid to be pulled from a remote source and then pushed to a delivery location. This pump generally exhibits more pumping power than the pump described in U.S. Pat. No. 7,517,306, but it is also larger with more components, making it more expensive, more difficult to assemble, and harder to package and ship.

Although the manually operated pumps described above have benefited farmers, their operation has revealed certain areas for improvement, described in detail below.

SUMMARY

In various implementations, this disclosure describes an improved manually operated pump. The improvements described herein are primarily directed to improvements to the hip pump described in U.S. Pat. No. 7,517,306. Rather than repeating the disclosure from that patent in the body of this application, it is incorporated by reference herein in its entirety.

In one aspect, the invention relates to a manually operate pump. The pump includes a base, a molded valve box of unitary construction pivotally mounted to the base, a cylinder removably mounted to the valve box, and a piston assembly at least partially disposed within the cylinder. The valve box can include (i) a valve chamber forming an inlet and an outlet and a divider disposed therebetween and (ii) a valve plate featuring an inlet valve in flow communication with the inlet and an outlet in flow communication with the outlet. The piston assembly can include a pump shaft having a distal end proximate to the valve box and a proximal end. The pump shaft can include a handle at the proximal end, a molded piston of unitary construction at the distal end, and a pair of opposing piston cups mounted to the piston.

In some embodiments of the above aspect, the valve chamber can include (i) an inlet angled surface adapted to direct fluid through the inlet valve and (ii) an outlet angled surface adapted to direct fluid through the outlet. The valve plate can further include a pair of shaped apertures adapted to accept a corresponding part of the inlet valve and the outlet valve, the part having a shape complementary to the shaped apertures, so as to secure the inlet valve and the outlet valve to the valve plate using no structural support beyond the shaped aperture. In some cases, the inlet valve and outlet valve are separate parts. In other cases, the inlet valve and the outlet valve are formed in a single molded part of unitary construction.

In some embodiments of the above aspect, the cylinder is removeably mounted to the valve box with a threaded interface. In some cases, the handle forms a T shape. In some instances, the pump also includes a stopper cap disposed at a proximal end of the cylinder and adapted to prevent the pump shaft from being fully pulled out of the cylinder. The stopper cap can include (i) an outer diameter greater than an outer diameter of the cylinder and (ii) a rim adapted to block a portion of a lumen formed by the cylinder. In some cases, the rim is adapted to engage at least one of the opposing piston cups to prevent the pump shaft from being fully pulled out of the cylinder.

In some embodiments of the above aspect, the pump also includes a filler cap forming an inlet disposed at the proximal end of the pump shaft and adapted to deliver a priming fluid into the cylinder through the piston assembly. The inlet can include a frustoconical shape. In some cases, the priming fluid is delivered to the pair of opposing piston cups through at least one weep hole formed in the piston. At 1650 meters, the pump can be adapted to pump fluid from at least 6 meters below the pump to at least 6 meters above the pump. In such instances, the average flow rate of the fluid can be at least about 0.225 liters per second.

In another aspect, a method of assembling a manually operated pump is provided. The method can include the steps of providing a base, pivotally mounting a molded valve box of unitary construction to the base, attaching a valve plate to cover a valve chamber of the valve box, inserting an inlet valve and an outlet valve into the valve plate, mounting a molded piston of unitary construction to a distal end of a pump shaft, mounting a pair of opposing piston cups to the molded piston, disposing a cylinder about at least a portion of the pump shaft, and removably mounting the cylinder to the valve box.

In some embodiments of the above aspect, the step of removeably mounting the cylinder to the valve box includes threading the cylinder onto the valve box with a threaded interface. In some cases, the method further includes the step of installing a stopper cap at a proximal end of the cylinder. The stopper cap can be adapted to prevent the pump shaft from being fully pulled out of the cylinder. In other cases, the method further includes the step of installing a filler cap forming an inlet at a proximal end of the pump shaft. The filler cap can be adapted to deliver a priming fluid into the cylinder. In some instances, the method further includes the step of installing a handle at the proximal end of the pump shaft.

BRIEF DESCRIPTION OF THE FIGURES

In the drawings, like reference characters generally refer to the same parts throughout the different views. Also, the drawings are not necessarily to scale, emphasis instead generally being placed upon illustrating the principles of the disclosed subject matter. In the following description, various embodiments are described with reference to the following drawings, in which.

DETAILED DESCRIPTION

Figure 1A:
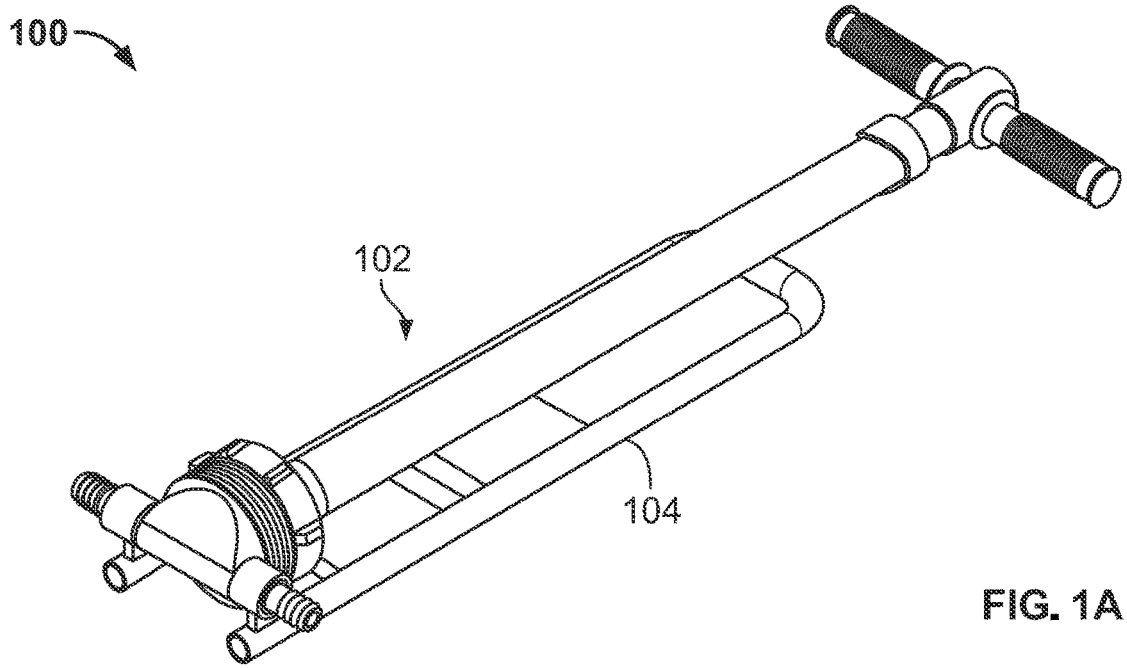
FIG. 1A is a schematic perspective view of a fully assembled pump in a collapsed state, according to various embodiments.
Figure 1B:
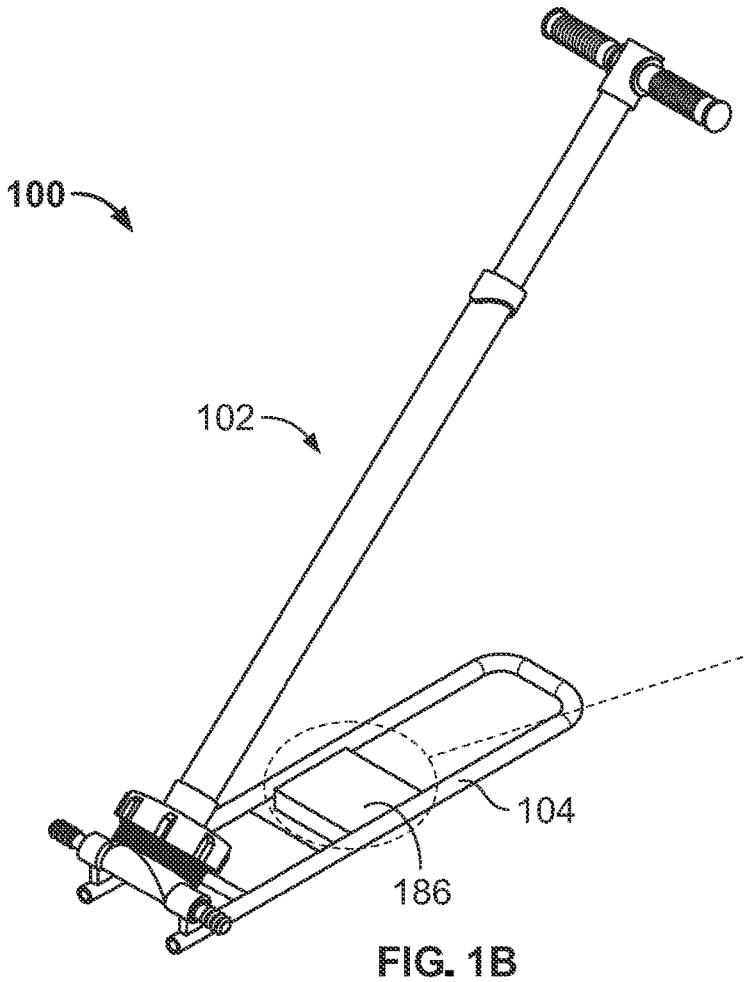
FIG. 1B is a schematic perspective view of the pump depicted in FIG. 1A, in a non-collapsed state.
Figure 1C:
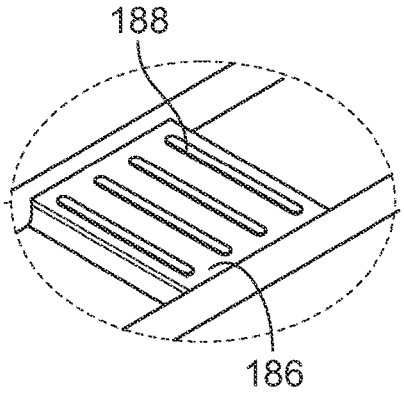
FIG. 1C is an enlarged view of a foot plate of the pump, according to various embodiments.

FIGS. 1A-1B depict a fully assembled manually operated pump 100 featuring the improvements over the hip pump described herein. As shown, the pump 100 includes a frame 102 pivotally mounted to a base 104, such that the frame 102 can rotate between the collapsed and non-collapsed configurations shown in FIG. 1A and FIG. 1B. The pump 100 can include at least one foot plate 186, which in some embodiments include grooves 188, as shown for example in FIG. 1C.

In various embodiments, the pump 100 features an improved valve box over the hip pump. In the hip pump, the valve box is formed of a separate inlet plate, a separate outlet plate, and separate connectors to the inlet and outlet pipes/tubes, all welded together. In some instances, this arrangement can make the valve box more difficult to manufacture. Also, the valve box is more susceptible to break and/or leak along the weld joints, which can adversely affect its performance.

Figure 2:
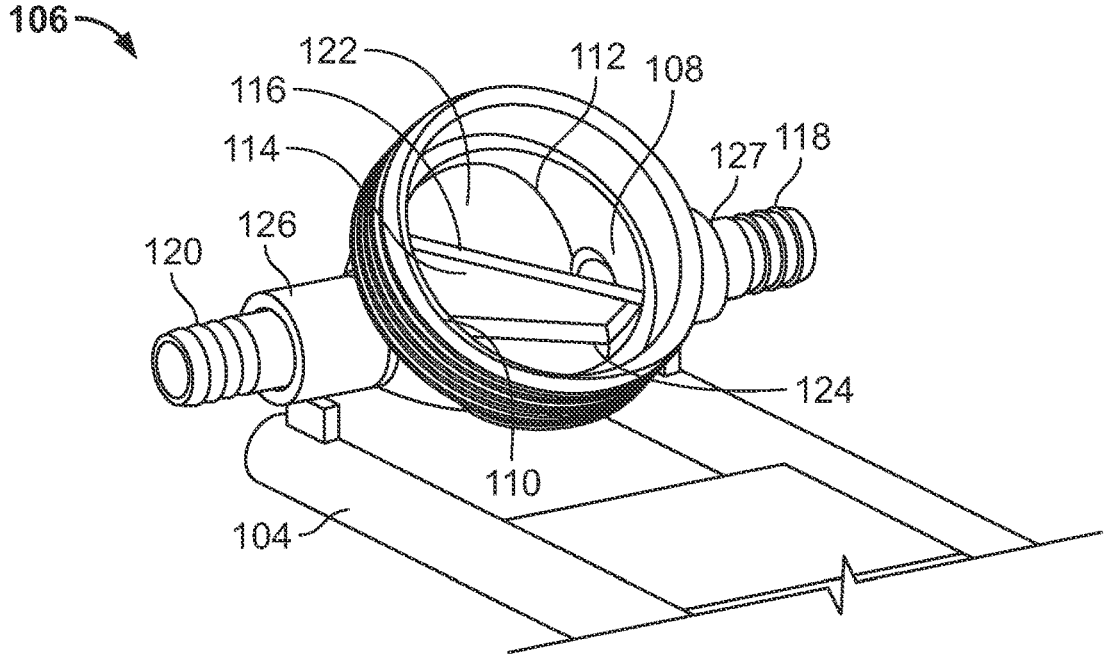
FIG. 2 is a schematic perspective view of a valve box pivotally mounted to a base, according to various embodiments.

FIG. 2 is a schematic depiction of a valve box 106 included in the pump 100. The valve box 106 can be molded (e.g., injection molded) from a single part of unitary construction. The single part can include an inlet 108 to an inlet chamber 112 and an outlet 110 from an outlet chamber 114. The inlet chamber 112 and outlet chamber 114 can be separated by a divider 116. Additionally the single part can include (i) an inlet connector 118 that fluidically connects an inlet pipe/tube in fluidic communication with a source reservoir to the inlet and (ii) an outlet connector 120 that fluidically connects the outlet 110 with an outlet pipe/tube. In some embodiments, the inlet chamber 112 includes an inlet angled surface 122 adapted to direct fluid through an inlet valve (described below), and the outlet chamber 114 includes an outlet angled surface 124 adapted to direct fluid through the outlet 110. As shown, in some embodiments, the inlet connector 118 and outlet connector 120 can be pivotally mounted within brackets 126, 127 of the base 104, to facilitate rotation of the valve box 106 with respect to the base 104.

Figure 3:
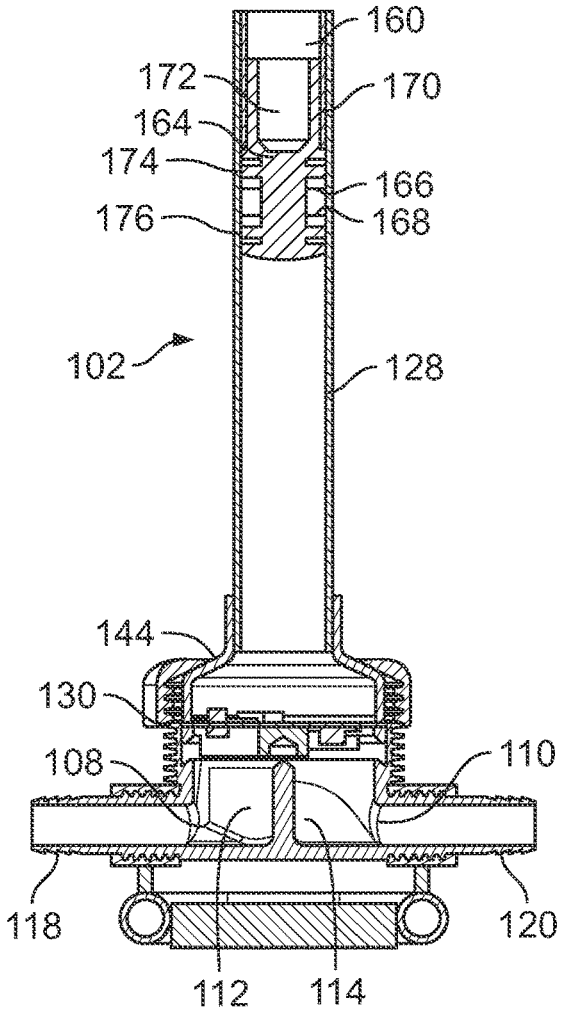
FIG. 3 is a schematic cross-sectional front view of a lower portion of a pump, according to various embodiments

FIG. 3 is a schematic cross-section view showing a cylinder 128 of the frame 102 mounted to the valve box 106. In some instances, the cylinder 128 is removeably mounted from the valve box 106. In general, any removeable mount can be used, for example, with a threaded interface 130, an interference fit, interlocking protrusion(s)/notch(es), etc. In some cases, the cylinder 128 can attach to a collar 144 to effect the removeable mount. For example, the collar 144 can include threads that engage corresponding threads on the valve box 106, to create the threaded interface 130. In other cases, the cylinder 128 can attach to the valve box 106 without the collar 144.

Figure 4:
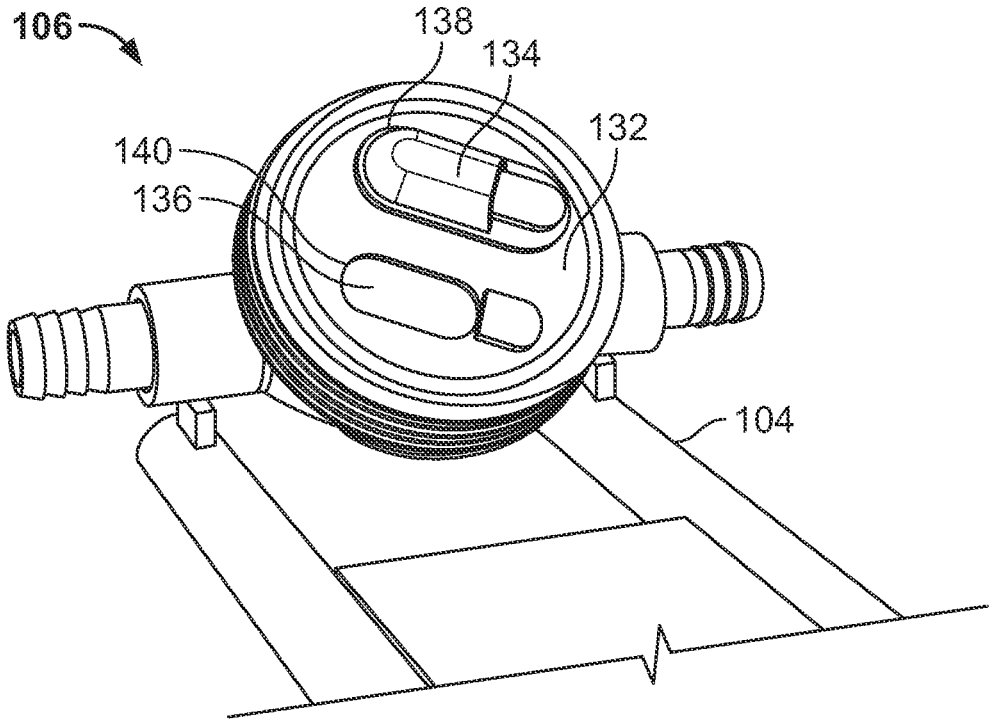
FIG. 4 is a schematic perspective view of a valve plate containing an inlet valve and an outlet valve mounted to the valve box, according to various embodiments.

As shown in FIG. 4, in various embodiments, a valve plate 132 is attached to the valve box 106 to cover the valve chambers 112, 114. The valve plate 132 can have an inlet valve 134 and an outlet valve 136 mounted thereto. Upon a piston being pulled upward into a cylinder (described below), fluid can be drawn up into the cylinder through the inlet valve 134. Upon the piston being pushed down into the cylinder (described below), fluid can be forced out of the cylinder through outlet valve 136. In order for the operation to work, the inlet valve 134 and outlet valve 136 are generally one-way valves. In some instances, the inlet valve 134 and outlet valve 136 can be angled/arranged such that, when the appropriate forces are applied, fluid from the inlet 108 easily opens the inlet valve 134 and fluid from the cylinder 128 easily opens the outlet valve 136.

Figure 4A:
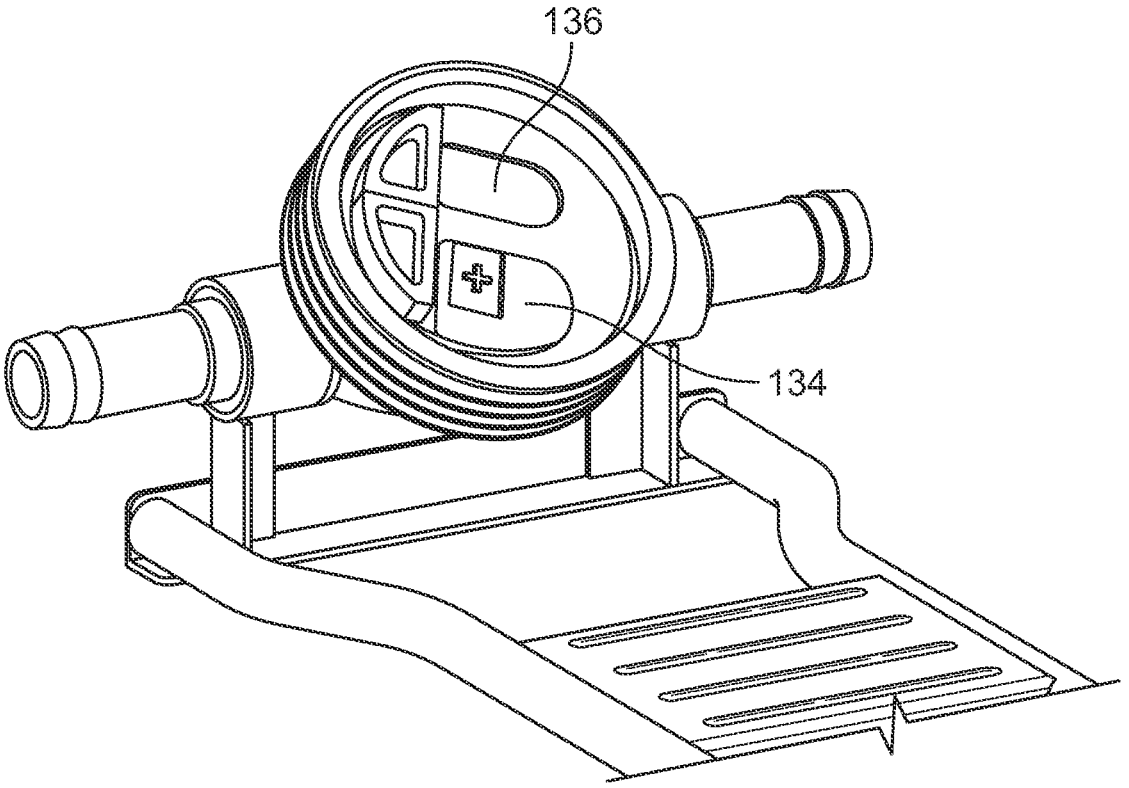
FIG. 4A is a schematic perspective view of a valve plate containing an inlet valve and an outlet valve having a different shape mounted to the valve box, according to various embodiments.

In general, the valves 134, 136 can take any suitable configuration and can be selected from numerous known valve types. As one example, the valve plate 132 can form two shaped apertures 138, 140, one for accepting the inlet valve 134 and the other for accepting the outlet valve 136. The shaped apertures 138, 140 can be adapted to accept a part of the valves 134, 136 having a shape complementary to the shaped apertures 138, 140. In some embodiments, the interaction between the complementary shapes of the shaped apertures 138, 140 and the valves 134, 136 is all that is required to secure the valves 134, 136 to the valve plate 132. This negates the need for attaching the valves 134, 136 using additional hardware (e.g., rivets, screws, etc.) which can complicate manufacture and repair. FIG. 4A depicts inlet valve 134 and outlet valve 136 having a different shape than that shown in FIG. 4. A more detailed description of shaped apertures 138, 140 and their interaction with valves 134, 136 is provided in U.S. Pat. No. 8,770,954, which is incorporated herein by reference, in its entirety.

Figure 5:
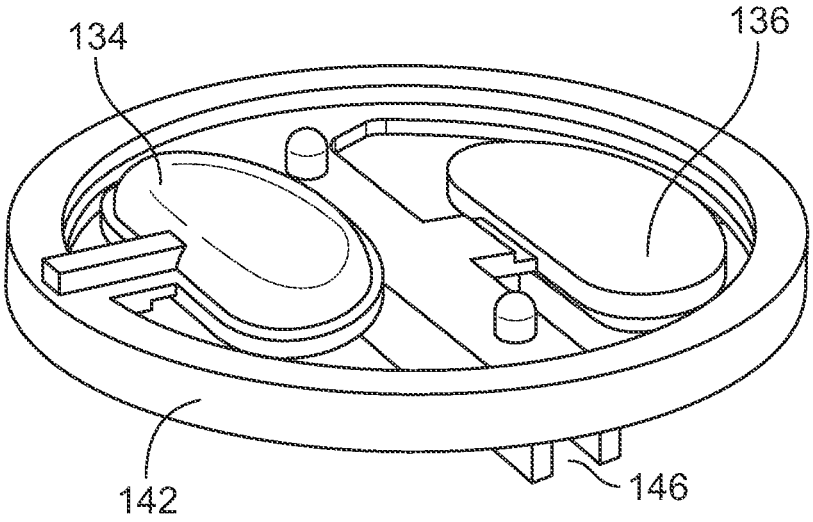
FIG. 5 is a schematic perspective view of an inlet valve and an outlet valve molded from a single part, according to various embodiments.
Figure 6:
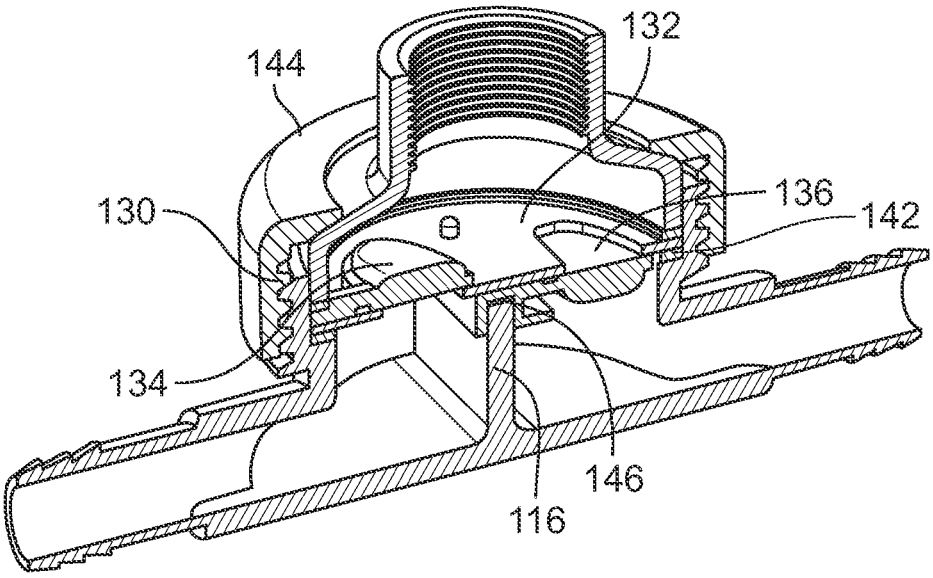
FIG. 6 is a schematic perspective view of the inlet valve and outlet valve molded from a single part shown in FIG. 5 mounted to a valve plate.

In some embodiments, as shown for example in FIG. 5, the inlet valve 134 and outlet valve 136 can be formed from a single molded (e.g., injection molded) part of unitary construction. The single part can also include a gasket 142 that can improve sealing between the valve plate 132 and the valve box 106. In some cases, the single part can include a groove 146 that aligns with the divider 116 of the valve box 106. FIG. 6 illustrates the single part installed within the valve plate 132.

In another embodiment, the valve plate 132 and the valve box 106 can be molded (e.g., injection molded) from the same part. In such embodiments, during manufacture, the base of the pump 100 can be open to allow injection punches to enter. Plastic plates can then be welded over the opening to ensure the pump 100 is water tight.

In various embodiments, the pump 100 also exhibits an improved priming mechanism from the hip pump. As described in U.S. Pat. No. 7,517,306, priming a pump by introducing fluid over the piston and the piston cups can help create an initial seal between the piston and the cylinder until the pumping fluid reaches the cylinder and maintains the seal. The priming fluid can also serve as an initial lubricant between the piston and the cylinder. However, in the hip pump, the primary way to prime the pump is to introduce priming fluid through a splash cap located at the top of the cylinder, which generally requires removal of the pump shaft.

Figure 7A:
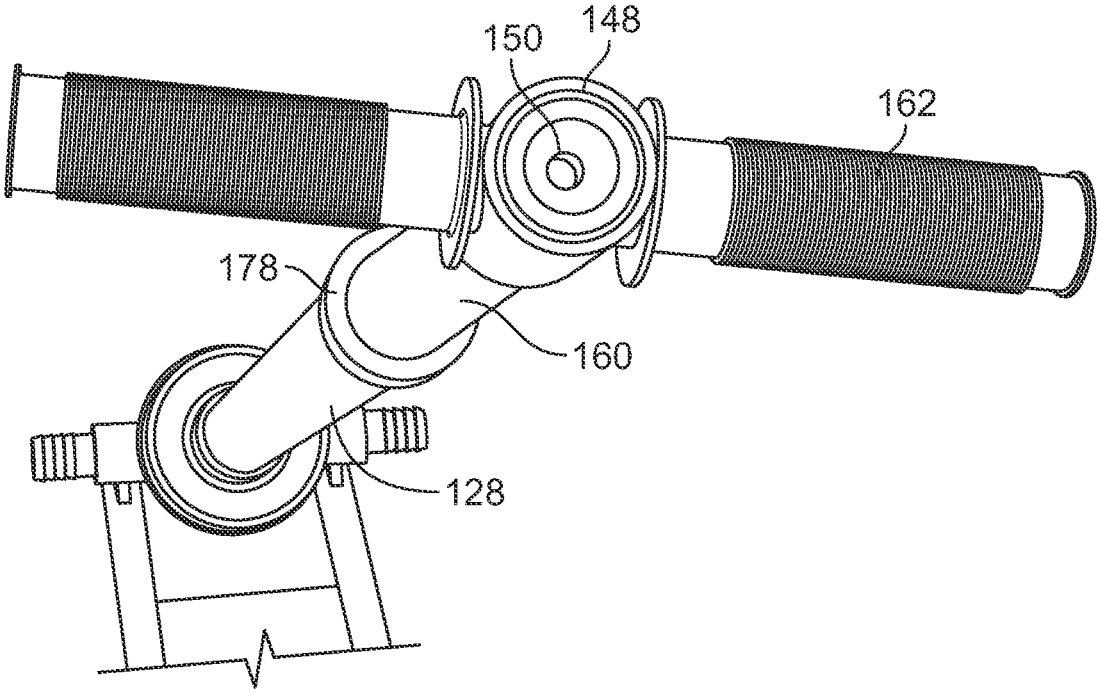
FIG. 7A is a schematic perspective view of a filler cap, according to various embodiments.
Figure 7B:
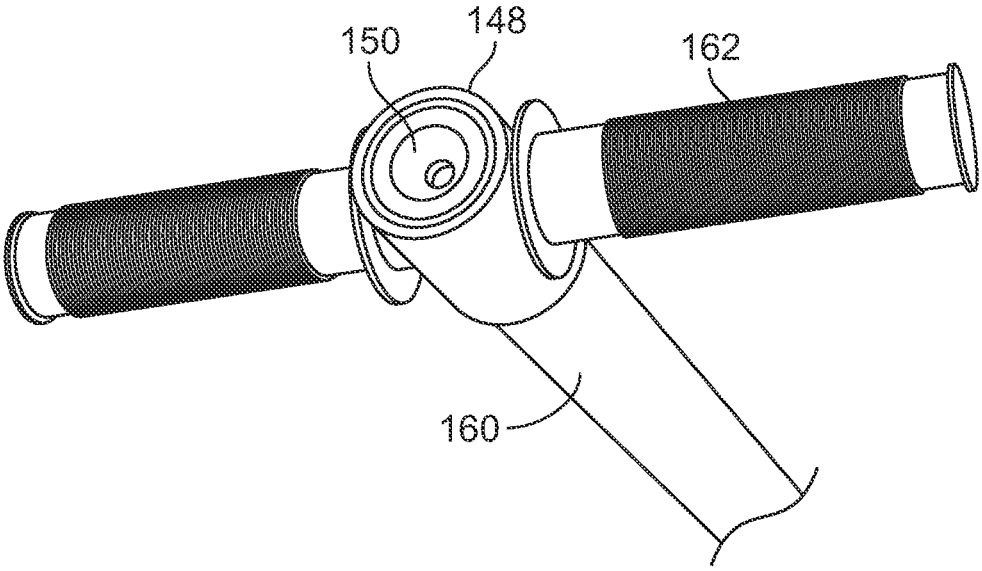
FIG. 7B is a different schematic perspective view of the filler cap shown in FIG. 7A.

Referring to FIGS. 7A-7B, in various embodiments, the pump 100 features a filler cap 148 for delivering a priming fluid into the cylinder 128, that can be disposed at a proximal end of a hollow pump shaft 160. In this disclosure, the proximal end refers to the end of an object further from the valve box 106 (i.e., closer to a pump operator). The filler cap 148 can be attached using any known technique, for example, an interference fit, threaded interface, interlocking protrusion(s)/notch(es). The filler cap 148 can form an inlet 150 leading to the interior of the hollow pump shaft 160. The inlet 150 can form a funnel and have a frustoconical shape.

Figures 10A, 10B, 10C:
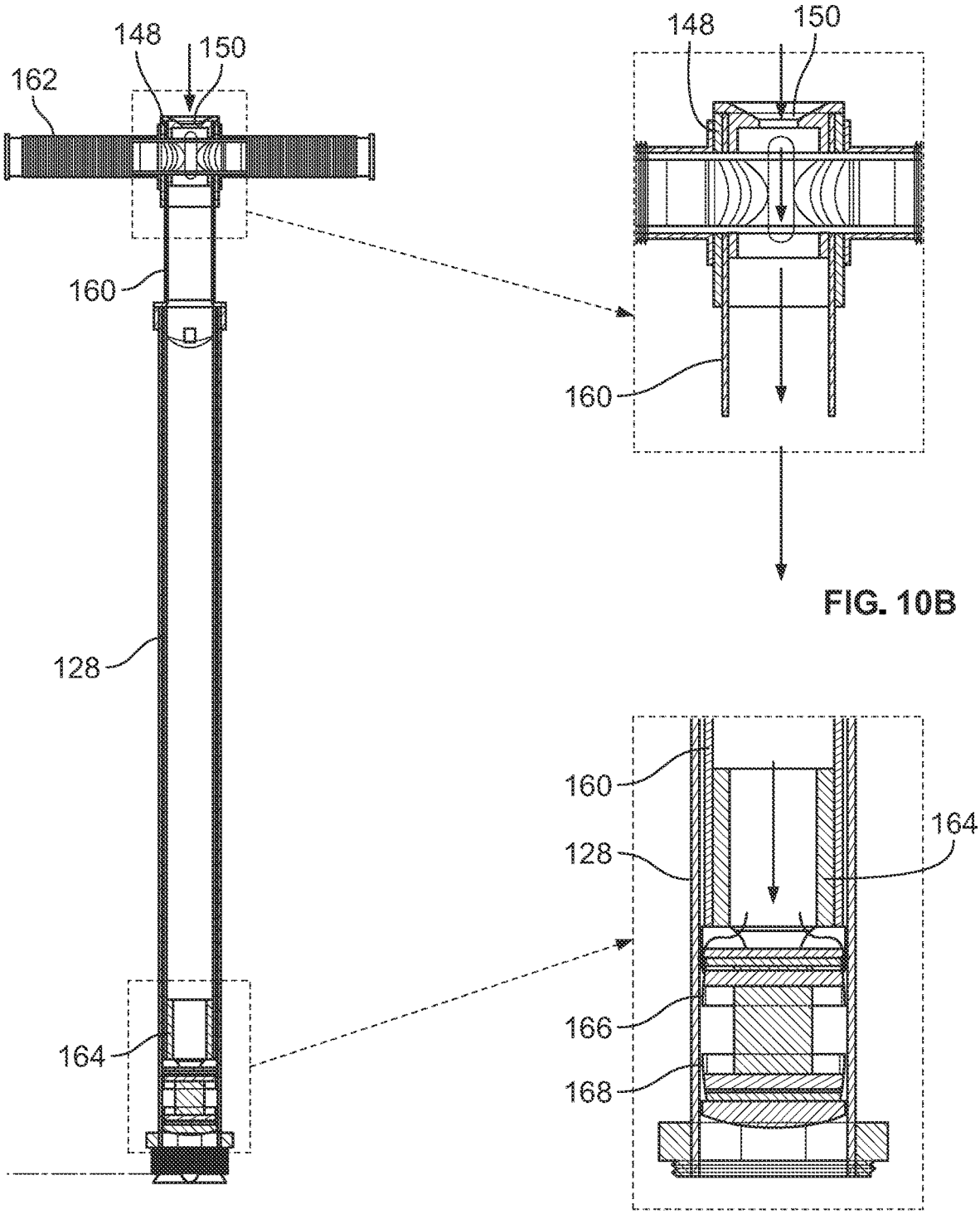
FIGS. 10A-10E illustrate a flow path of a priming fluid, according to various embodiments.
Figure 10D:
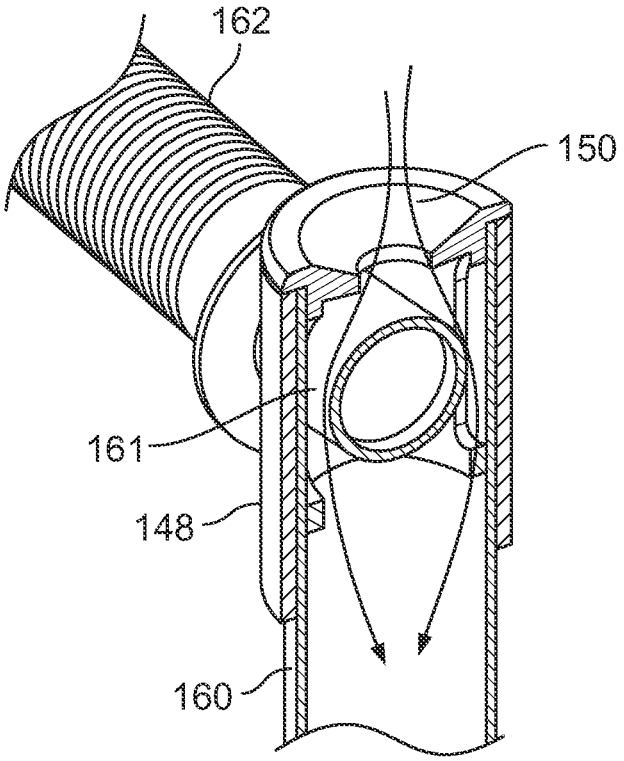
Figure 10E:
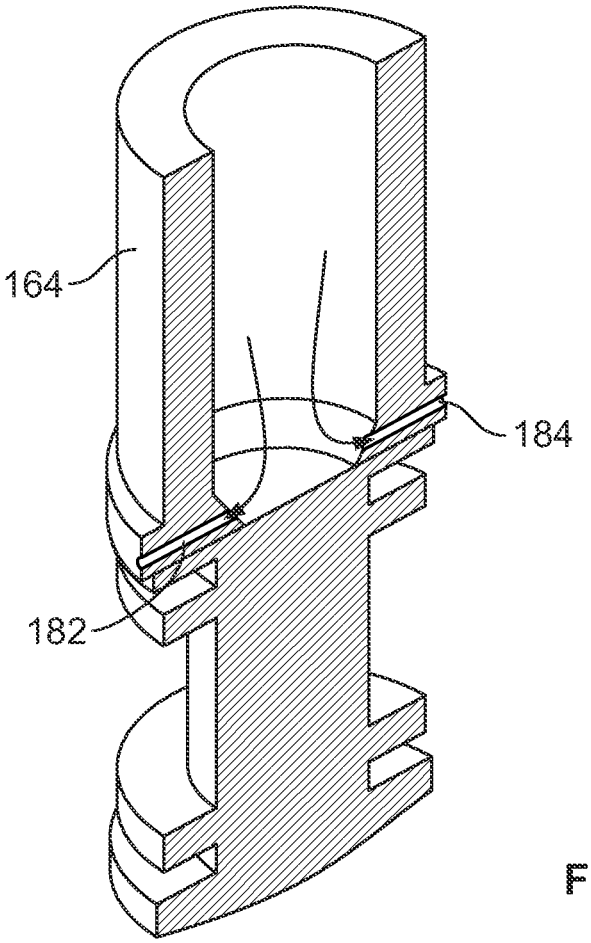

FIGS. 10A-10E illustrate an example flow path of a priming fluid introduced into the inlet 150 of the filler cap 148. As shown in FIGS. 10B and 10D, the priming fluid can initially traverse the handle 162 through a radial gap 161 between the handle 162 and an interior wall of the filler cap 148 and/or the pump shaft 160. The priming fluid can be transported down the hollow pump shaft 160 until it reaches a piston 164 (described below). As shown in FIGS. 10C and 10E, the piston 164 can include weep holes 182, 184 located above piston cups 166, 168 (described below). The priming fluid can exit the weep holes 182, 184 and flow over the piston cups 166, 168 and/or through a radial gap between the piston cups 166, 168 and the cylinder 128. In other instances, the weep holes can instead be located in the pump shaft 160, above the piston 164. In still other instances, the fluid can exit out the bottom of the hollow pump shaft 160. Regardless of the configuration, the priming fluid can be delivered into the cylinder 128 without needing to remove the pump shaft 160 from the cylinder 128.

In some instances, a handle 162 (e.g., a T-shaped handle) can also be attached at the proximal end of the hollow pump shaft 160. Given the proximity of the handle 162 and the filler cap 158, in some cases, an operator can insert the priming fluid into the filler cap 148, while holding the handle 162.

In various embodiments, the pump 100 also exhibits an improved piston from the hip pump. In the hip pump, the piston is formed from multiple disks separately attached to the pump shaft. Turning back to FIG. 3, the pump 100 can include a piston 164. The piston 164 can be pulled up into the cylinder 128 to draw fluid from the inlet 108, through the inlet valve 134 and into the cylinder 128. The piston 164 can also be pushed down into the cylinder 128 to force fluid out of the cylinder 128, through outlet valve 136 and out outlet 110. Unlike the hip pump, the piston 164 can be formed from a single molded (e.g., injection molded) part of unitary construction. The molded part can have a complex shape adapted to at least one of (i) support and/or accept the pump shaft 160, and (ii) house an upper piston cup 166 and an opposing lower piston cup 168. For example, the piston 164 can form (i) a post 170 about which the pump shaft 160 can fit and/or (ii) an aperture 172 into which the pump shaft 160 can be inserted. The piston 164 can also form shelves 174, 176 onto which the piston cups 166, 168 can be mounted.

The piston cups 166, 168 can form a seal with the inner wall of the cylinder 128 to prevent air from entering the system and adversely affecting the operation of the pump 100. In some cases, the piston cups 166, 168 can include a deformable outer rim that is (i) deflected outward upon application of a force in one direction along the longitudinal axis of the cylinder 128 and (ii) deflected inward upon application of a force in the opposing direction along the longitudinal axis of the cylinder 128. The piston cups 166, 168 can be arranged in opposite orientations, such that when the outer rim of the lower piston cup 166 is deformed outwards, the outer rim of the upper piston cup 168 is deformed inwards and vice versa. With this configuration, regardless of whether the piston 164 is being pulled or pushed within the cylinder 128, one of the piston cups 166, 168 is deforming outward against the inner wall of the cylinder 128 to prevent air from entering the lower portion of the cylinder 128 (e.g., the portion that fills with fluid on an up stroke of the piston 164).

In various embodiments, the pump 100 exhibits an improvement over the hip pump in that its pump shaft 160 is wider than that of the hip pump. In some cases the outer diameter of the pump shaft 160 is within a millimeter or a few millimeters of the inner diameter of the cylinder 160. The wider pump shaft 160 is more durable and less susceptible to deformation (e.g., buckling, bending, etc.) than a narrower pump shaft. However, a wider pump shaft 160 necessarily creates less room within the interior of the cylinder for other parts. For example, the hip pump includes a cylinder cap within the interior of the cylinder that prevents the pump shaft from being pulled out of the cylinder. The wider pump shaft 160 of pump 100 leaves less room for the cylinder cap within the interior of the cylinder 128.

Figure 8:
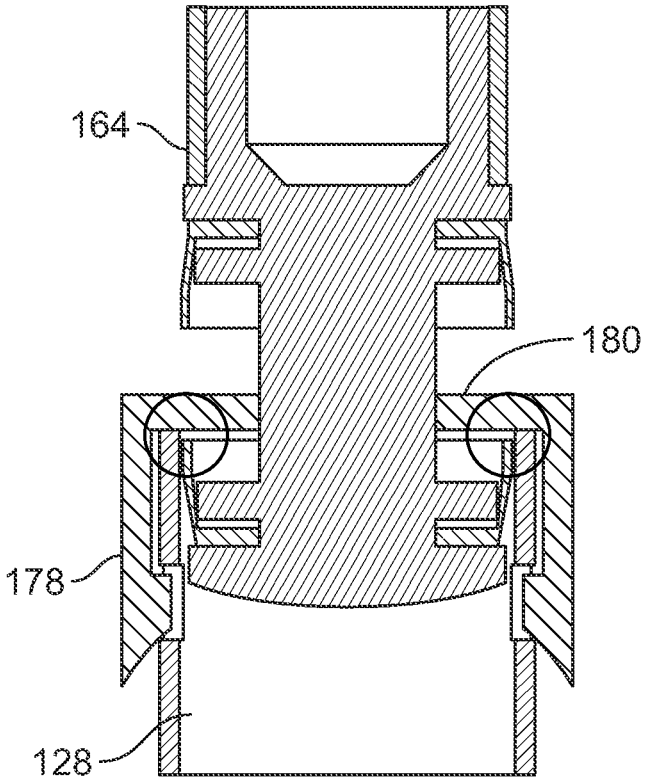
FIG. 8 is a schematic cross-sectional front view of a stopper cap attached to a cylinder, according to various embodiments.
Figure 9:
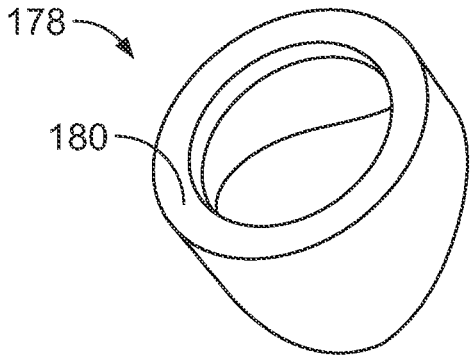
FIG. 9 is a schematic perspective view of the stopper cap shown in FIG. 8, in isolation.

Accordingly, in various embodiments, the pump 128 includes a stopper cap 178 that can attach at a proximal end of the cylinder 128, about an exterior of the cylinder 128. FIG. 8 depicts an example stopper cap 178 installed with the cylinder 128. FIG. 9 depicts the example stopper cap 178 in isolation. In general, the stopper cap 178 can attach about the exterior of the cylinder 128 using any known technique, for example, an interference fit, a threaded interface, interlocking protrusions(s)/notch(es). For example, in some cases, the outer diameter of the stopper cap 178 is greater than the outer diameter of the cylinder 128. The stopper cap can also include a rim 180 that juts inward from the outer diameter of the stopper cap 178 and blocks a portion of a lumen formed by the cylinder 128. In this configuration, the stopper cap 178 can prevent the pump shaft 160 from being fully pulled out of the cylinder 128. For example, if the pump shaft 160 is pulled too far up into the cylinder 128, then the upper piston cup 166 may have its outer rim deformed inward by the rim 180 and be pulled out of the cylinder 128: however, the lower piston cup 168 would have its outer rim deformed outward by the rim 180 and thereby engage the rim 180, which would prevent the pump shaft 160 from being fully pulled out of the cylinder 128. In some embodiments, the rim 180 can have an inner diameter close to the outer diameter of the pump shaft 160, e.g., with only enough clearance to ensure that the pump shaft 160 can slide therethrough.

In various embodiments, the pump 100 can exhibit the following performance parameters. At 1,650 meters above sea level, the pump 100 can pump fluid from at least 6 meters below the pump to at least 6 meters above the pump, at an average flow rate of at least about 0.225 liters per second. At sea level, the pump 100 can pump fluid from at least 7 meters below the pump to at least 7 meters above the pump, at an average flow rate of at least about 0.225 liters per second. At 1,650 meters above sea level, the pump 100 can pump fluid from at least 5 meters below the pump to at least 5 meters above the pump, at an average flow rate of at least about 0.45 liters per second.

Figure 11A:
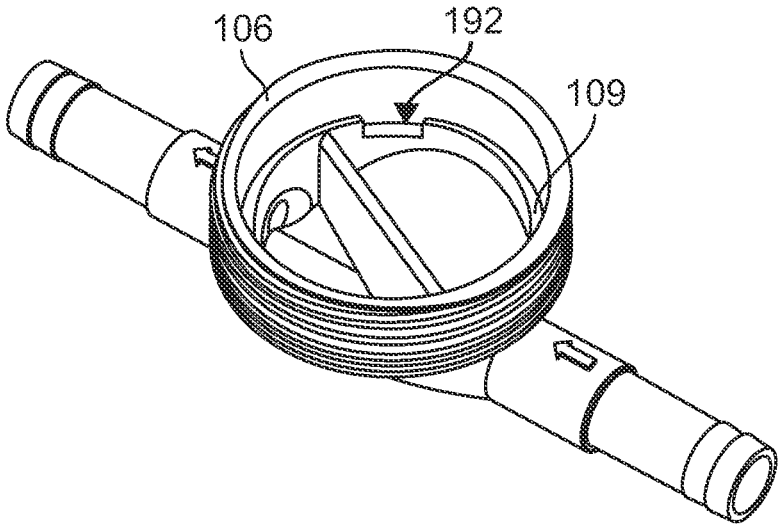
FIGS. 11A-11C are schematic perspective views of a valve box and a gasket designed to help ensure proper orientation of an installed valve plate, according to various embodiments.
Figure 11B:
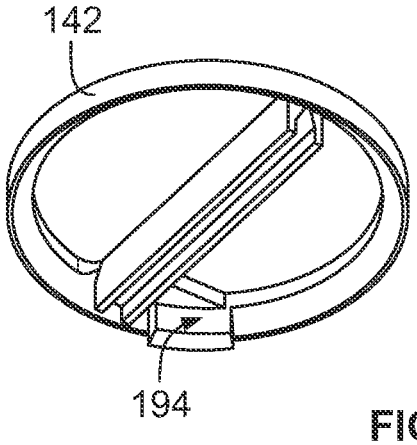
Figure 12A:
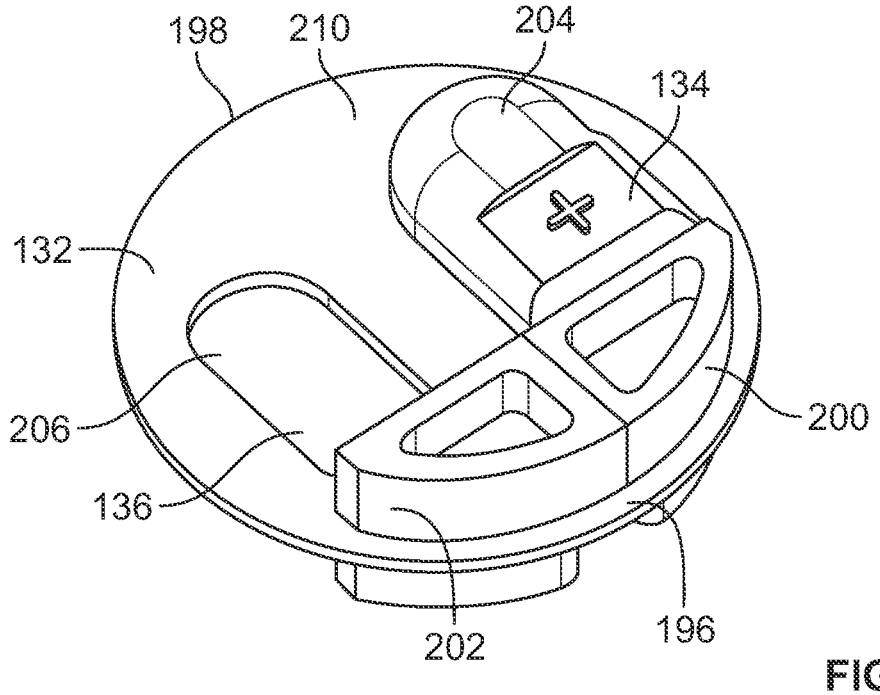
FIGS. 12A-12B are schematic perspective views of a valve plate assembly, according to various embodiments.

In various embodiments, the pump 100 includes features that help ensure that the inlet valve 134 and the outlet valve 136 are installed in the correct orientation. For example, as shown in FIGS. 11A-B, the valve box 106 can include a rim 190 having a notch 192 that corresponds to a tab 194 on the gasket 142. This can ensure that the gasket 142 is installed in the correct orientation. In some embodiments, the gasket 142 is shaped such that the valve plate 132 having the inlet valve 134 and the outlet valve 136 mounted thereto (sometimes referred to as the "valve plate assembly") can only be installed in a particular orientation. In some instances, orientation of the valve plate assembly can be described with reference to the position of a hinge end 196 and a flap end 198. As shown for example in FIG. 12A, the hinge end 196 can be proximate to the hinge portions 200, 202 of the valves 134, 136 and the flap end 198 can be proximate to the flap portions 204, 206 of the valves 134, 136.

Figure 11C:
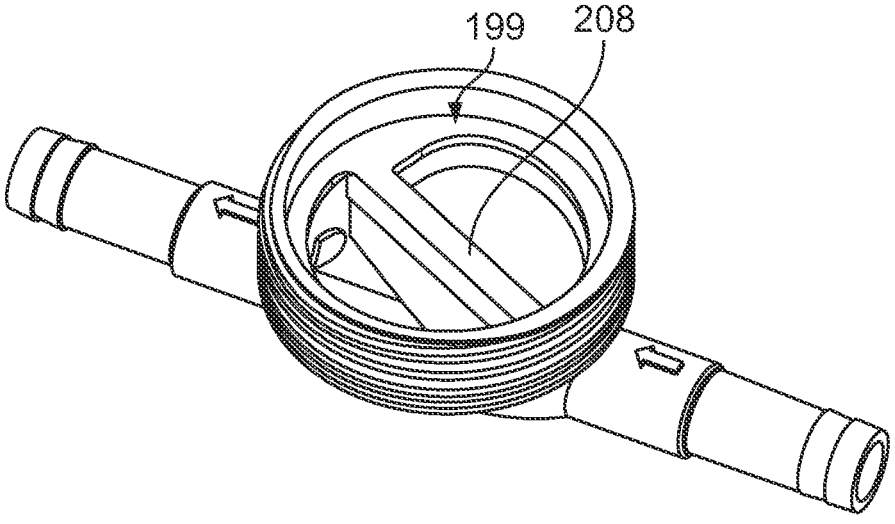

As one example, the gasket 142 can include a blocking portion 199 (see FIG. 11C) that will block the hinge portions 200, 202 but provide enough clearance for the flap portions 204, 206, which can ensure that the hinge end 196 and the flap end 198 are located in the correct orientation when the valve plate assembly is installed.

Figure 12B:
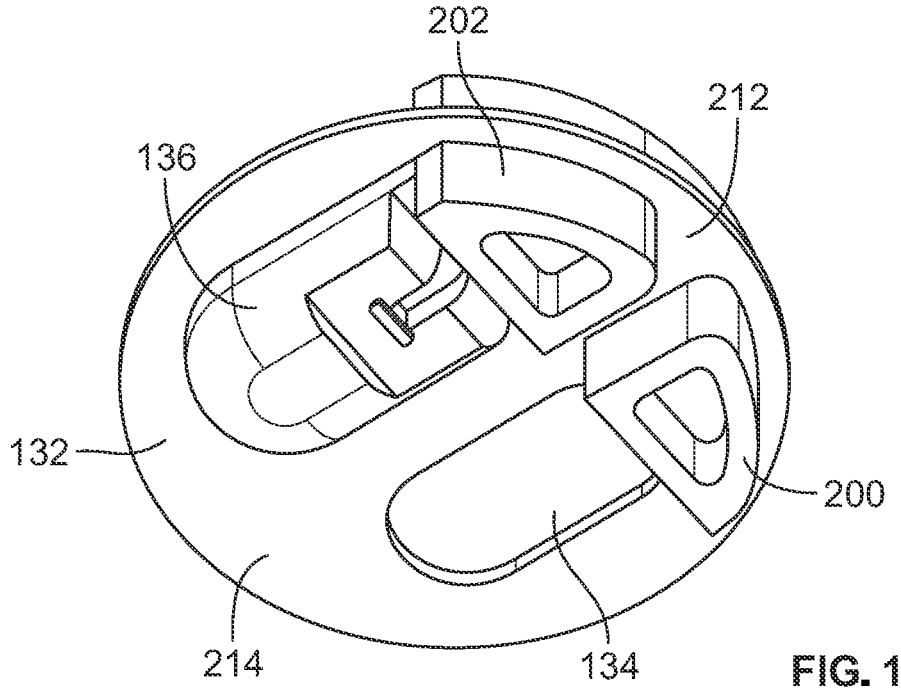

In some instances, the valve box 106 and/or the gasket 142 can form a ridge 208 (e.g., formed by the divider 116). In some such instances, the hinge portions 200, 202 of the valves 134, 136 can be shaped such that they are close together (e.g., adjacent or flush) on a top side 210 of the valve plate 132, such that the ridge 208 will block the valve plate assembly from being installed if it is installed upside down. As shown for example in FIG. 12B, the hinge portions 200, 202 of the valves 134, 136 can be shaped such that there is a space 212 between them on the bottom side 214 of the valve plate 132. The space 212 can accept the ridge 208 when the valve plate assembly is installed right side up.

Figure 13:
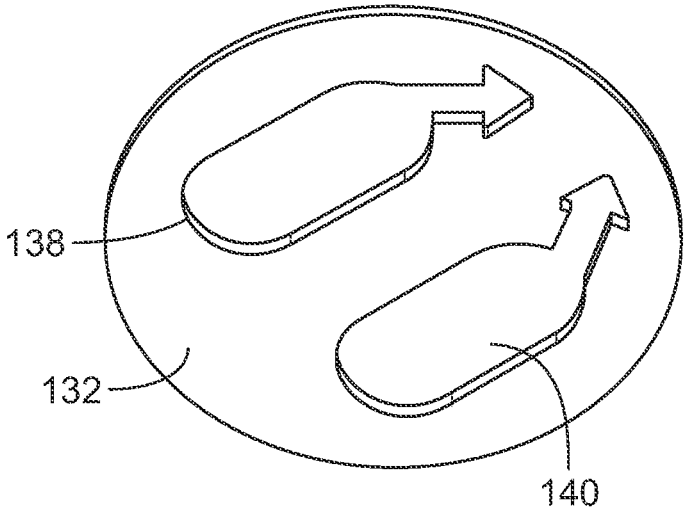
FIG. 13 is a schematic perspective view of a valve plate having apertures shaped to help ensure proper orientation of installed valves, according to various embodiments.
Figure 14:
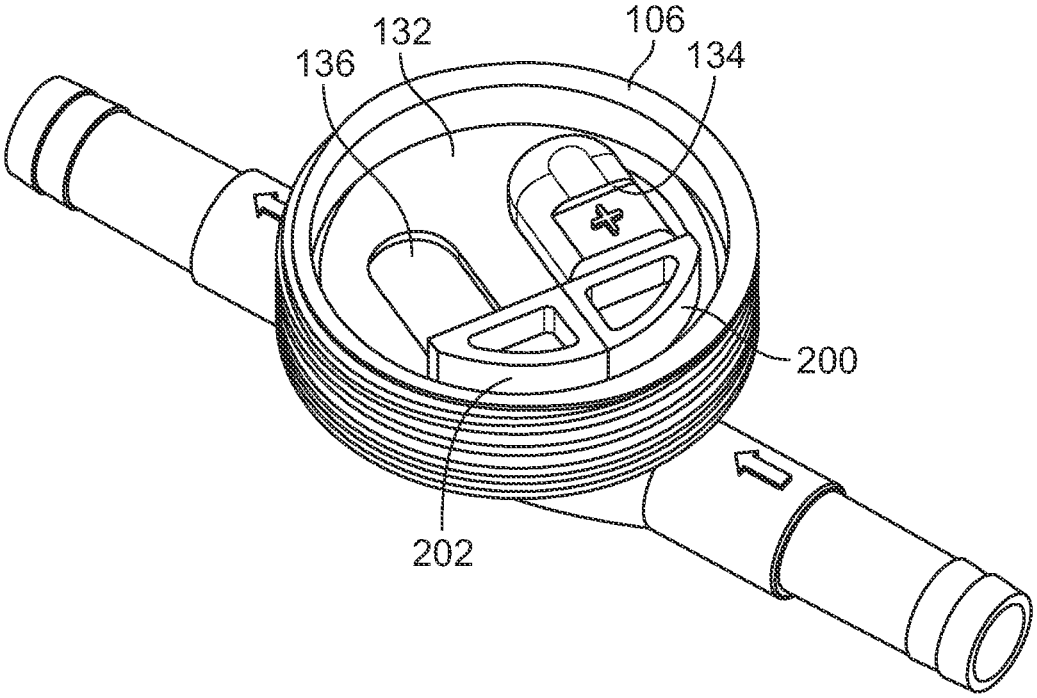
FIG. 14 is a schematic perspective view of an installed valve plate, according to various embodiments.

In various embodiments, the valve plate 132 and/or the valves 134, 136 can be shaped such that the valves 134, 136 are only received in the correct location/orientation. For example, as mentioned above, in some embodiments shaped apertures 138, 140 of the valve plate 132 can be adapted to accept a part of the valves 134, 136 having a shape complementary to the shaped apertures 138, 140. In some such embodiments, the shape of the inlet valve 134 may only be complementary to the shape of the shaped aperture into which the inlet valve 134 is to be inserted and not be complementary to the shape of the shaped aperture into which the outlet valve 136 is to be inserted. Similarly, the shape of the outlet valve 136 may only be complementary to the shape of the shaped aperture into which the outlet valve 136 is to be inserted and not be complementary to the shape of the shaped aperture into which the inlet valve 134 is to be inserted. For example, the shaped apertures 138, 140 may have different orientations (e.g., one complementary to the inlet valve 134 and the other complementary to the outlet valve 136) as shown, for example, in FIG. 13 in which the arrow shaped portions of the shaped apertures have different orientations. FIG. 14 is a top perspective view showing a valve plate assembly installed properly using some of the techniques described above.

The terms and expressions employed herein are used as terms and expressions of description and not of limitation and there is no intention, in the use of such terms and expressions, of excluding any equivalents of the features shown and described or portions thereof. In addition, having described certain embodiments of the invention, it will be apparent to those of ordinary skill in the art that other embodiments incorporating the concepts disclosed herein may be used without departing from the spirit and scope of the invention. The structural features and functions of the various embodiments may be arranged in various combinations and permutations, and all are considered to be within the scope of the disclosed invention. Unless otherwise necessitated, recited steps in the various methods may be performed in any order and certain steps may be performed substantially simultaneously. Accordingly, the described embodiments are to be considered in all respects as only illustrative and not restrictive. Furthermore, the configurations described herein are intended as illustrative and in no way limiting. Similarly, although physical explanations have been provided for explanatory purposes, there is no intent to be bound by any particular theory or mechanism, or to limit the claims in accordance therewith.

What is claimed is:

1. A manually operated pump comprising:

a base;

a valve box of unitary construction pivotally mounted to the base, the valve box comprising:

an inlet chamber, an outlet chamber, and a divider disposed therebetween;

and a valve plate including an inlet valve in flow communication with the inlet chamber, an outlet valve in flow communication with the outlet chamber, and a gasket having a groove that aligns with the divider of the valve box of unitary construction, wherein the inlet valve and the outlet valve are formed as a single molded part of unitary construction, wherein the single molded part of unitary construction includes a ridge formed by a divider, and the single molded part of unitary construction is configured to be installed within the valve plate;

a cylinder removably mounted to the valve box of unitary construction; and a piston assembly at least partially disposed within the cylinder, the piston assembly comprising:

a pump shaft including a distal end proximate to the valve box of unitary construction and a proximal end, the pump shaft further including:

a handle at the proximal end; a molded piston of unitary construction at the distal end; and a pair of opposing piston cups mounted to the molded piston of unitary construction.

2. The manually operated pump of claim 1, wherein the valve-inlet chamber comprises: an inlet angled surface adapted to direct a fluid through the inlet valve; and the outlet chamber includes an outlet angled surface adapted to direct the fluid through the outlet.

3. The manually operated pump of claim 1, wherein the valve plate further comprises:

a pair of shaped apertures adapted to accept a corresponding part of the inlet valve and the outlet valve, the corresponding part having a shape complementary to the pair of shaped apertures, so as to secure the inlet valve and the outlet valve to the valve plate using no structural support beyond the pair of shaped apertures.

4. The manually operated pump of claim 1, wherein the inlet valve and the outlet valve are separate parts.

5. The manually operated pump of claim 1, wherein the cylinder is removably mounted to the valve box with a threaded interface.

6. The manually operated pump of claim 1, wherein the handle forms a T shape.

7. The manually operated pump of claim 1 further comprising a stopper cap disposed at a proximal end of the cylinder and adapted to prevent the pump shaft from being fully pulled out of the cylinder.

8. The manually operated pump of claim 7, wherein the stopper cap comprises:

an outer diameter greater than an outer diameter of the cylinder; and a rim adapted to block a portion of a lumen formed by the cylinder.

9. The manually operated pump of claim 8, wherein the rim is adapted to engage at least one of the opposing piston cups to prevent the pump shaft from being fully pulled out of the cylinder.

10. The manually operated pump of claim 1, wherein the inlet comprises a frustoconical shape.

11. The manually operated pump of claim 1, wherein a priming fluid is delivered to the pair of opposing piston cups through at least one weep hole formed in the piston.

12. The manually operated pump of claim 1, wherein, at 1650 meters altitude, the pump is adapted to pump a fluid from at least 6 meters below the pump to at least 6 meters above the pump.

13. The manually operated pump of claim 12, wherein the pump is further adapted to pump the fluid at an average flow rate of at least about 0.225 liters per second.

14. A manually operated pump comprising:

a molded valve box of unitary construction pivotally mounted to a base, the molded valve box of unitary construction including:

a valve chamber forming an inlet chamber, and an outlet chamber, and including a divider disposed therebetween; and a valve plate including an inlet valve in flow communication with the inlet chamber and an outlet valve in flow communication with the outlet chamber;

a cylinder removably mounted to the molded valve box of unitary construction; and a piston assembly at least partially disposed within the cylinder, the piston assembly including:

a pump shaft including a distal end proximate to the valve box and a proximal end, the pump shaft further including:

a handle at the proximal end;

a molded piston of unitary construction at the distal end;

a pair of opposing piston cups mounted to the molded piston of unitary construction; and a filler cap forming an inlet disposed at the proximal end of the pump shaft and configured to direct-deliver a priming fluid into the cylinder via the piston assembly by traversing the handle via a gap between the handle and the filler cap or between the handle and the pump shaft.

15. A manually operated pump, comprising:

a base;

a valve box of unitary construction pivotally mounted to the base, the valve box including:

an inlet chamber, an outlet chamber, and a divider disposed therebetween; and a valve plate including an inlet valve in flow communication with the inlet chamber, an outlet valve in flow communication with the outlet chamber, and a gasket having a groove that aligns with the divider of the valve box of unitary construction, wherein the inlet valve and the outlet valve are formed in a single molded part of unitary construction having a ridge formed by the divider, wherein the single molded part is configured to be installed within the valve plate;

a cylinder removably mounted to the valve box; and a piston assembly at least partially disposed within the cylinder, the piston assembly including:

a pump shaft having a distal end proximate to the valve box and a proximal end, the pump shaft comprising a handle at the proximal end;

a molded piston of unitary construction at the distal end; and a pair of opposing piston cups mounted to the molded piston of unitary construction.

16. The manually operated pump of claim 15, wherein the handle forms a T shape.

17. The manually operated pump of claim 15, wherein the cylinder is removably mounted to the valve box with a threaded interface.

18. The manually operated pump of claim 15, further comprising:

a stopper cap disposed at a proximal end of the cylinder and adapted to prevent the pump shaft from being fully pulled out of the cylinder.

* * * * *